US011523481B2

(12) United States Patent
Zhang et al.

(10) Patent No.: US 11,523,481 B2
(45) Date of Patent: Dec. 6, 2022

(54) COMBINATIONAL CIRCUIT AND CONTROL CIRCUIT

(71) Applicant: OPPLE LIGHTING CO., LTD., Shanghai (CN)

(72) Inventors: Pingwei Zhang, Shanghai (CN); Weiwei Yang, Shanghai (CN)

(73) Assignee: Oppie Lighting Co., Ltd., Shanghai (CN)

( * ) Notice: Subject to any disclaimer, the term of this patent is extended or adjusted under 35 U.S.C. 154(b) by 383 days.

(21) Appl. No.: 16/893,005

(22) Filed: Jun. 4, 2020

(65) Prior Publication Data

US 2020/0305249 A1 Sep. 24, 2020

Related U.S. Application Data

(63) Continuation of application No. PCT/CN2018/119011, filed on Dec. 3, 2018.

(30) Foreign Application Priority Data

Dec. 5, 2017 (CN) ..... 201711268754.5
Dec. 5, 2017 (CN) ..... 201721671367.1

(51) Int. Cl.
*H05B 45/20* (2020.01)
*H05B 45/14* (2020.01)
(Continued)

(52) U.S. Cl.
CPC ..... *H05B 45/20* (2020.01); *H05B 45/00* (2020.01); *H05B 45/14* (2020.01); *H05B 45/24* (2020.01)

(58) Field of Classification Search
CPC ..... H05B 45/00; H05B 45/10; H05B 45/14; H05B 45/20; H05B 45/24; H05B 45/37;
(Continued)

(56) References Cited

U.S. PATENT DOCUMENTS 6,437,575 B1 * 8/2002 Lin ..... G01R 19/16538 324/711
8,222,584 B2 * 7/2012 Rains, Jr. ..... F21V 23/0457 362/231
(Continued)

FOREIGN PATENT DOCUMENTS

CN 101945515 A 1/2011
CN 206629299 U 11/2017
(Continued)

OTHER PUBLICATIONS

International Search Report of PCT Application No. PCT/CN2018/119011 dated Feb. 28, 2019, (9p).

*Primary Examiner* — Haissa Philogene
(74) *Attorney, Agent, or Firm* — Arch & Lake LLP

(57) ABSTRACT

The present disclosure provides a combinational circuit and a control circuit. The combinational circuit is applied to an LED drive circuit and includes a detection module and a drive and logic conversion module connected with the detection module. The detection module is configured to detect a state of an external switch, generate a detection signal according to the state of the external switch as detected, and send the detection signal to the drive and logic conversion module; and the drive and logic conversion module is configured to receive the detection signal from the detection module, generate a driving signal according to the detection signal, and drive an operation state of a discharge module for discharging an output electrolytic capacitor of the LED drive circuit by using a state of the driving signal.

16 Claims, 1 Drawing Sheet

(51) Int. Cl.
*H05B 45/24* (2020.01)
*H05B 45/00* (2022.01)

(58) Field of Classification Search
CPC .. H05B 45/355; H05B 45/385; H05B 45/395; Y02B 20/30
See application file for complete search history.

(56) References Cited

U.S. PATENT DOCUMENTS

| | | | | |
|---|---|---|---|---|
| 10,764,979 | B1 * | 9/2020 | Lewis | F21V 23/0457 |
| 2012/0313917 | A1 * | 12/2012 | Yamada | H05B 45/3725 315/297 |
| 2016/0212809 | A1 * | 7/2016 | Xiong | H05B 45/3725 |
| 2017/0321849 | A1 * | 11/2017 | Xiong | F21V 25/02 |
| 2022/0101781 | A1 * | 3/2022 | Baumheinrich | G09G 3/32 |

FOREIGN PATENT DOCUMENTS

| | | | |
|---|---|---|---|
| CN | 107995732 | A | 5/2018 |
| CN | 207766600 | U | 8/2018 |

* cited by examiner

COMBINATIONAL CIRCUIT AND CONTROL CIRCUIT

CROSS-REFERENCE TO RELATED APPLICATIONS

This application is based upon and claims the priority of PCT patent application No. PCT/CN2018/119011 filed on Dec. 3, 2018 which claims the priority of Chinese Patent Application No. 201711268754.5 filed on Dec. 5, 2017 and Chinese Patent Application No. 201721671367.1 filed on Dec. 5, 2017, the entire content of all of which is hereby incorporated by reference herein for all purposes.

TECHNICAL FIELD

The present disclosure relates to a technical field of illumination, in particular to a combinational circuit and a control circuit.

BACKGROUND

Because light-emitting diode (LED) has the advantages of energy saving, environmental protection, high efficiency, and safety, it is widely used in landscape, street lamps, and electronic products backlight. With the wide application of LED, there are more and more requirements for products that use a switch to switch the color temperature or brightness of LED in the market.

SUMMARY

The present disclosure provides a combinational circuit, a control circuit and an LED drive circuit.

According to a first aspect, a combinational circuit is disclosed. The combinational circuit may be applied to an LED drive circuit and the combinational circuit may include a detection module and a drive and logic conversion module connected with the detection module. The detection module may be configured to detect a state of an external switch, generate a detection signal according to the state of the external switch as detected, and send the detection signal to the drive and logic conversion module; and the drive and logic conversion module may be configured to receive the detection signal from the detection module, generate a driving signal according to the detection signal, and drive an operation state of a discharge module for discharging an output electrolytic capacitor of the LED drive circuit by using a state of the driving signal.

According to a second aspect, a control circuit is provided. The control circuit may be applied to an LED drive circuit. The control circuit may include a switch module, a discharge module, and a combinational circuit. The combinational circuit may include a detection module and a drive and logic conversion module connected with the detection module. The detection module may be configured to detect a state of an external switch, generate a detection signal according to the state of the external switch as detected, and send the detection signal to the drive and logic conversion module; and the drive and logic conversion module may be configured to receive the detection signal from the detection module, generate a driving signal according to the detection signal, and drive an operation state of a discharge module for discharging an output electrolytic capacitor of the LED drive circuit by using a state of the driving signal.

The switch module may be connected with at least two sets of light sources, and may be configured to receive a switching signal from an external switch and switch a color temperature and/or brightness of the at least two sets of light sources according to the switching signal; and the discharge module may be respectively connected with the switch module and the drive and logic conversion module in the combinational circuit, and may be configured to receive the driving signal output by the drive and logic conversion module, drive a self-state by using a state of the driving signal, and discharge the output electrolytic capacitor of the LED drive circuit upon the self-state being an operation state, so that the output electrolytic capacitor does not discharge through a light source which currently emits light, after the switch module switches the color temperature and/or brightness of the at least two sets of light sources.

According to a third aspect, an LED drive circuit may be provided. The LED drive circuit may include a detection circuit and a drive and logic conversion circuit connected with the detection circuit. The detection circuit may be configured to detect a state of an external switch, generate a detection signal according to the state of the external switch as detected, and send the detection signal to the drive and logic conversion circuit; and the drive and logic conversion circuit may be configured to receive the detection signal from the detection circuit, generate a driving signal according to the detection signal, and drive an operation state of a discharge circuit for discharging an output electrolytic capacitor of the LED drive circuit by using a state of the driving signal.

It is to be understood that both the foregoing general description and the following detailed description are exemplary and explanatory only and are not restrictive of the present disclosure.

BRIEF DESCRIPTION OF THE DRAWINGS

The drawings described herein are used to provide a further understanding of the present disclosure and form a part of the present disclosure. The illustrative examples of the present disclosure and the description thereof are used to explain the present disclosure and do not constitute an improper limitation of the present disclosure. In the drawings.

DETAILED DESCRIPTION

Figure 1:
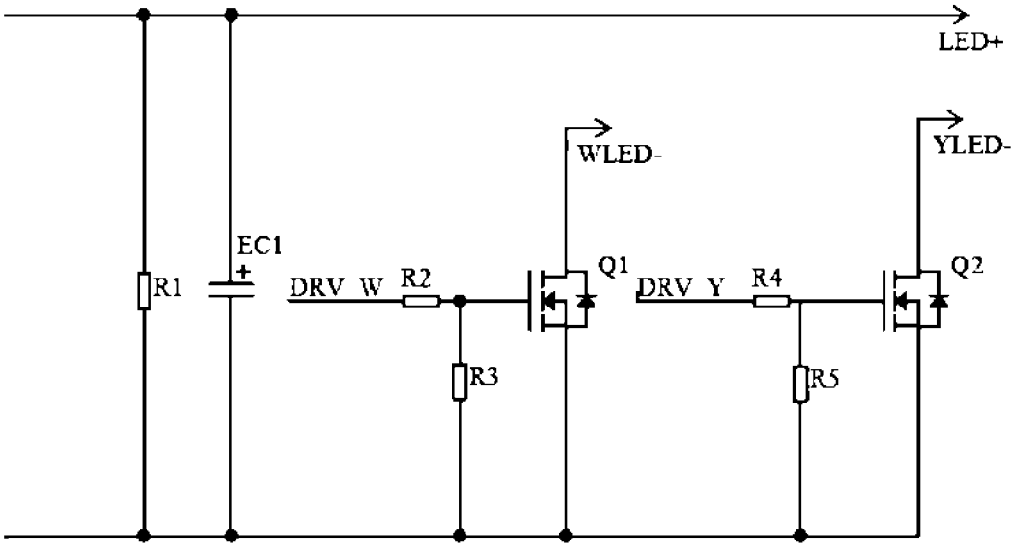
FIG. 1 is a schematic circuit diagram of a part of an LED driving circuit.

Examples of the present disclosure are described in a more detailed way with reference to the accompanying drawings. Although the examples of the present disclosure are shown in the drawings, it should be understood that the present disclosure may be implemented in various forms and should not be limited by the examples set forth herein.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Sometimes, in the actual use process of products that use a switch to switch the color temperature or brightness of LED, especially for high power factor LED products, there is a problem that LED flickers upon the switch being used to switch the color temperature or brightness of LED, thus causing poor user experience for users of LED products.

For example, upon a circuit shown in FIG. 1 being used to switch the color temperature of LED, there is a problem that the LED flickers. First, the working principle of the circuit is introduced herein; assuming that the LED product defaults to that a white LED (WLED- in FIG. 1 represents a white LED) is turned on at the beginning; upon the circuit being powered on for the first time, DRV_W (in which DRV refers to a driving signal, and DRV_W refers to a driving signal input to the white LED) is a high level, and DRV_Y (refers to a driving signal input to a yellow LED) is a low level, a switch transistor (e.g. a MOS transistor shown in FIG. 1) Q1 is turned on, a switch transistor Q2 is turned off, and the white LED is turned on; upon an external switch (not shown in FIG. 1) being switched, the circuit detects a switching signal, DRV_W is a low level, DWR_Y is a high level, the switch transistor Q1 is turned off, the switch Q2 is turned on, and a yellow LED (YLED- in FIG. 1 represents a yellow LED) is turned on. The present working principle can also be applied to LED products that switch brightness.

In some implementations, the output electrolytic capacity of the LED drive circuit is relatively large, especially for single-stage PFC drive, and the output usually requires a large electrolytic capacitor to smooth the power frequency ripple of the output current. Therefore, upon the switch being used to switch the color temperature of LED, the LED will flicker. Specifically, assuming that the white LED is currently in an ON state, Q1 is ON, and Q2 is OFF; the switch is turned off, and Q1 and Q2 are turned off; the switch is turned on, Q1 is turned off and Q2 is turned on. At the moment when the switch is turned off, because Q1 and Q2 are both turned off, the output electrolytic capacity is relatively large, and the output electrolytic capacitor has no fast discharge circuit with low impedance, and can only be discharged through an output load resistor R1, which usually has a large resistance value (more than tens of K ohms), and the discharge time is quite long. If the switch is turned off quickly, Q1 is turned off, and Q2 is turned on; at the moment that the drive being not work, the residual energy on the output electrolytic capacitor will be released through the yellow LED, so that the yellow LED flickers visually when the switch is switched quickly. Similarly, in a LED product in which a switch being used to switch brightness of the LED, the LED also flickers visually when the switch is switched quickly.

Figure 2:
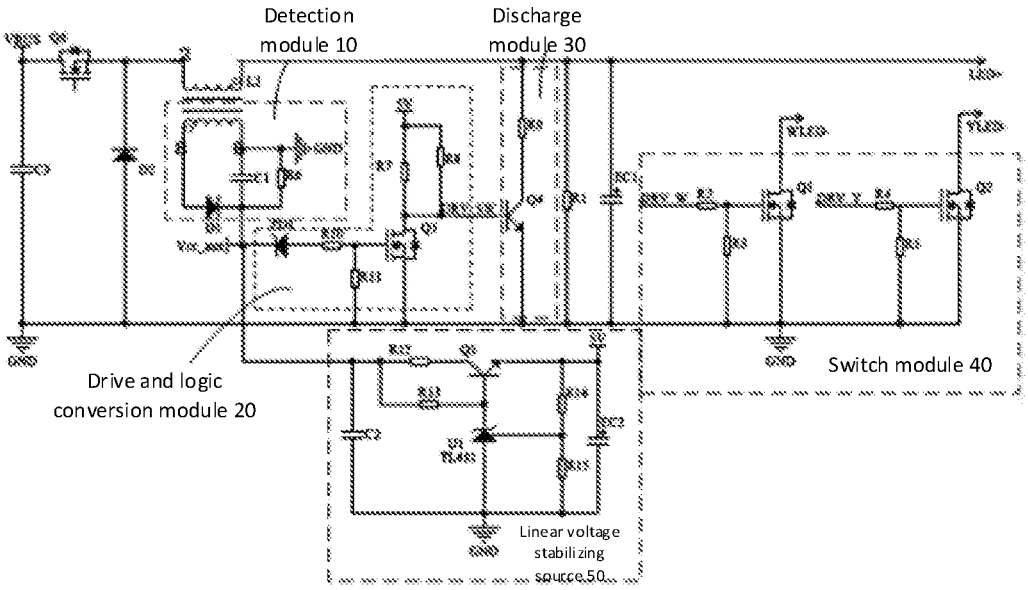
FIG. 2 is a schematic circuit diagram of a part of a control circuit according to an example of the present disclosure.

An example of the present disclosure provides a combinational circuit which is applied to an LED drive circuit. Referring to FIG. 2, a topology structure of the LED drive circuit of the example of the present disclosure adopts a floating high power factor BUCK circuit (i.e., a step-down conversion circuit). An application process of the combinational circuit of the present disclosure will be described herein. The combinational circuit includes a detection module 10 and a drive and logic conversion module 20 connected with the detection module 10. The detection module 10 is configured to detect a state of an external switch (not shown in FIG. 2), generate a detection signal according to the state of the external switch as detected, and then send the detection signal to the drive and logic conversion module 20. The drive and logic conversion module 20 is configured to receive the detection signal from the detection module 10, and generate a driving signal according to the detection signal, thereby driving an operation state of a discharge module 30 for discharging an output electrolytic capacitor EC1 of the LED drive circuit by using the state of the driving signal.

In the present example, the LED drive circuit includes an output electrolytic capacitor EC1, which can be discharged upon the discharge module 30 being in an operation state. Next, a driving process of the operation state of the discharge module 30 driven by the detection module 10 and the drive and logic conversion module 20 will be described. Specifically, upon the state of the external switch being in an OFF state, the detection signal generated by the detection module 10 according to the state of the external switch is a low level, the driving signal generated by the drive and logic conversion module 20 according to the detection signal of a low level is a high level, and drives the discharge module 30 to work, so that the discharge module 30 discharges the output electrolytic capacitor EC1 of the LED drive circuit. Upon the state of the external switch being in an ON state, the detection signal generated by the detection module 10 according to the state of the external switch is a high level, and the driving signal generated by the drive and logic conversion module 20 according to the detection signal of a high level is a low level. In this case, the discharge module 30 does not work, that is, the discharge module 30 will not discharge the output electrolytic capacitor EC1.

The example of the present disclosure can be applied to the working scene where a light source flickers when the LED drive circuit switches color temperature and/or brightness of the light source by using a switch, so as to eliminate or control the flicker of the light source. In the case where an external switch is used to switch the color temperature and/or brightness of the light source, the detection module 10 and the drive and logic conversion module 20 cooperate with each other to drive the discharge module 30 to release energy on the output electrolytic capacitor EC1, thereby avoiding the problem that the light source flickers upon emitting light due to residual energy on the output electrolytic capacitor EC1. Therefore, no visual stroboscopic phenomenon occurs in the process of switching the color temperature and/or brightness of the light source by using the switch, and user experience is improved. Because it is easy for a current high power factor LED product to generate the flicker of the light source upon switching the color temperature and/or brightness of the light source through a switch, the technical solution of the present disclosure can be well applied to a high power LED product with a power factor greater than 0.7.

With continued reference to FIG. 2, in an example of the present disclosure, the detection module 10 includes a first resistor, a capacitor device, a diode, and an auxiliary winding of a power inductor; the first resistor is connected in parallel with the capacitor device, and the diode and the auxiliary winding of the power inductor are connected in series and then connected in parallel with the capacitor device. In FIG. 2, the first resistor is resistor R6, the capacitor device is capacitor C1, the diode is D1, the power inductor is L2, and the auxiliary windings of the power inductor L2 are pins 6 and 8.

If the state of the external switch is ON, a voltage on the auxiliary winding of the power inductor L2 is a high-frequency pulsating alternating-current (AC) square wave, and the voltage on the auxiliary winding of the power inductor L2 is rectified and filtered through the diode D1 and the capacitor C1 to generate the detection signal of a high level. If the state of the external switch is OFF, the diode D1 is turned off and the detection signal of a low level is generated.

In the present example, the drive and logic conversion module 20 includes a zener diode ZD1, resistors R7, R8, R10, R11, and a switching transistor (e.g., a MOS transistor shown in FIG. 2) Q3. One end of the zener diode ZD1 is connected with the capacitor C1, and the other end of the zener diode ZD1 is connected with a gate electrode of the MOS transistor Q3. Upon the detection signal generated by the detection module 10 being a low level, the zener diode ZD1 is turned off, and the MOS transistor Q3 is driven to turn off, and the output electrolytic capacitor EC1 is discharged through the discharge module 30. If the detection signal generated by the detection module 10 is a high level, the zener diode ZD1 is turned on and broken down, and drives the MOS transistor Q3 to conduct, so that the discharge module 30 does not work.

Based on the same inventive concept, the present disclosure also provides a control circuit, which is applied to an LED drive circuit. With continued reference to FIG. 2, the control circuit includes a discharge module 30, a switch module 40, and a combinational circuit in any one of the above examples (the combinational circuit includes a detection module 10 and a drive and logic conversion module 20). The switch module 40 is connected with at least two sets of light sources, and is configured to receive a switching signal from an external switch and switch the color temperature and/or brightness of the at least two sets of light sources according to the switching signal. The at least two sets of light sources are used as the load of the LED drive circuit. The present example shows two sets of light sources, one set is represented by WLED-, which refers to a white LED, and the other set is represented by YLED-, which refers to a yellow LED. In the present example, the condition for the external switch to generate the switching signal may be that, if the external switch is in an ON state, the switching signal is generated upon the external switch being turned off and then turned on. The examples of the present disclosure do not specifically limit the number of sets of the light sources.

The discharge module 30 is respectively connected with the switch module 40 and the drive and logic conversion module 20, and is configured to receive the driving signal output by the drive and logic conversion module 20, drive a self-state by using a state of the driving signal, and discharge the output electrolytic capacitor of the LED drive circuit upon the self-state being an operation state, so that the output electrolytic capacitor EC1 is not discharged through a light source currently emits light, after the switch module 40 switches the color temperature and/or brightness of at least two sets of light sources.

In the present example, the control circuit can be applied to a working scene where a light source flickers when the LED drive circuit switches color temperature and/or brightness of the light source by using a switch. The color temperature switching refers to the switching of light sources with different colors. If an application scene of the control circuit of the present disclosure is a scene for switching the color temperature of the light source, the at least two sets of light sources include light sources with at least two colors, and different sets of the at least two sets of light sources have different colors. For example, if one set of light sources has white color and the other set of light sources has yellow color, then the control circuit can switch the color temperature between white and yellow. Light sources of other colors can be included, and the examples of the present disclosure are not limited herein. The control circuit of the example shown in FIG. 2 is a scene applied to switching the color temperature.

Brightness switching refers to the switching of light sources with different brightness. If the application scene of the control circuit of the present disclosure is a scene for switching the brightness of light sources, different sets of the at least two sets of light sources have different numbers of light sources. For example, if the number of light sources in one set is 3 and the number of light sources with the same type in the other sets is 5, then the control circuit can switch brightness between 3 light sources and 5 light sources. It is also possible to switch the brightness by setting different types of light sources in at least two sets of light sources. For example, in three sets of light sources have the same number of light sources, one set of light sources has a power of 3 W, and the other two sets of light sources have a power of 5 W and 8 W, respectively, such that the switching of brightness of LED can also be achieved.

It is also possible to switch color temperature and brightness at the same time. In this case, the at least two sets of light sources include light sources of at least two colors, and different sets of the at least two sets of light sources have different colors and different numbers of light sources.

In an example of the present disclosure, the process of the discharge module 30 driving its own operation state according to the driving signal output by the drive and logic conversion module 20 may include: if the driving signal is a low level, the discharge module 30 drives its own operation state to be inoperative according to the driving signal of a low level; if the driving signal is a high level, the discharge module 30 drives its own operation state to work according to the driving signal of a high level.

In the present example, the discharge module 30 includes a second resistor and a triode, one end of the second resistor is connected with a collector of the triode and the other end of the second resistor is connected with one end of the output electrolytic capacitor EC1, the other end of the output electrolytic capacitor EC1 is connected with an emitter of the triode. In FIG. 2, the second resistor is resistor R9 and the triode is transistor Q4. If the state of the external switch is OFF, the detection signal generated by the detection module 10 according to the state of the external switch is a low level, the zener diode ZD1 is turned off, the drive MOS transistor Q3 is turned off, the drive of the MOS transistor Q4 becomes high, that is, the triode Q4 is turned on, and the output electrolytic capacitor EC1 is discharged through the resistor R9 and the triode Q4.

In order to more clearly embody the example of the present disclosure, the switch module 40 switches LEDs of different colors to emit light and an operation process of the discharge module 30 during the present period will be described with an example.

Referring to FIG. 2, in the present example, in the case where the light source LED (i.e., WLED- and YLED- shown in FIG. 2, WLED- refers to a white LED and YLED- refers to a yellow LED) is operating normally, DRV_SW (DRV refers to a driving signal) is a low level, the transistor Q4 of discharge module 30 is turned off, Q1 is turned on, Q2 is turned off, and the white LED is turned on.

Upon DRV_SW being a high level, transistor Q4 is turned on, and Q1 and Q2 are turned off. Because the resistance value of the resistor R9 connected in series with the triode Q4 is extremely small, the energy on the output electrolytic capacitor EC1 is rapidly released through the resistor R9 and the transistor Q4 of the discharge module 30. The resistance value of resistor R9 can be determined according to the actual circuit and the output electrolytic capacity value. In general, the resistance value of resistor R9 can be selected from 100 ohms to 1K ohms. The examples of the present disclosure do not specifically limit the resistance value of R9.

When DRV_SW reaches a low level again, the transistor Q4 is turned off, Q1 is turned off, Q2 is turned on, and the yellow LED is turned on. Because the energy on the electrolytic capacitor EC1 has been released through the resistor R9 and the transistor Q4 after the switch was turned off last time. Therefore, the residual energy on the output electrolytic capacitor EC1 will not cause the flicker of the LED before the switch module 40 starts to operate. When the switch module 40 starts to work, the switch module 40 can normally complete the switching function of the color temperature of the LED, so that visual stroboscopic phenomenon will not occur in the process of switching the color temperature of the LED.

Similarly, in the scene where the brightness of the light source is switched by a switch, the above-mentioned method can also eliminate the visual stroboscopic phenomenon in the switching process. In this case, in the at least two sets of light sources, different sets of the at least two sets of light sources have different numbers of LEDs, and the brightness of the light sources can be switched by switching among the sets of light sources having different numbers of LEDs.

In addition, in an illumination equipment which uses a switch to switch the brightness and color temperature of the light source at the same time, the above-mentioned method can also be adopted to eliminate the visual stroboscopic phenomenon in the switching process. In this case, in the at least two sets of light sources, different sets of the at least two sets of light sources have different numbers of LEDs and different colors, and the switching of the brightness and color temperature of the light source can be achieved by switching among the sets having different numbers and/or different colors of LEDs.

In another example of the present disclosure, the control circuit further includes a linear voltage stabilizing source 50, which is connected with the detection module 10, and is configured to receive a detection signal from the detection module 10, and provide a stable voltage for the drive and logic conversion module 20 according to the detection signal.

The control circuit of the example of the present disclosure can be applied to any topology structure of an LED drive circuit. In the example shown in FIG. 2, the buck circuit adopted in the topology structure includes a capacitor C3, a switching transistor (i.e., a MOS transistor) Q6, a main winding L2 (i.e., pins 2 and 4), a freewheeling diode D2, and an output electrolytic capacitor EC1. The gate electrode of the MOS transistor Q6 is connected with an integrated circuit (IC), and the drive IC (not shown in the figure) is the control IC of the LED drive circuit, which is referred to herein as IC1. In addition, the control circuit may also include a special color temperature/brightness switching control IC or a single chip microcomputer, which is referred to herein as IC2 (not shown in the figure). IC2 and its peripheral circuits synchronously detect the switching state of the switch, and IC2 also has its own detection circuit (the detection circuit here is different from the detection module 10 described above). Upon IC2 receiving a switch control signal of the external switch, switching signals, namely DRV_W and DRV_Y in FIG. 2, can be generated for switching between WLED- and YLED-.

The complete working process of the control circuit of the example of the present disclosure will be described in detail below.

The external switch is turned on, and the LED drive circuit works normally. The voltage on the main winding (i.e., pins 2 and 4) of the power inductor L2 in the detection module 10 is a high frequency pulsating AC square wave. The voltage on the auxiliary winding (i.e. pins 6 and 8) of the power inductor L2 after magnetic coupling is also a high frequency pulsating AC square wave. After the voltage on the auxiliary winding of the power inductor L2 is rectified and filtered by the diode D1 and the capacitor C1 of the detection module 10, Vcc_aux is a high level. In the example of the present disclosure, the voltage value of the high level of Vcc_aux is about 12V. Other voltage values may be used for the high level of Vcc_aux, and the example of the present disclosure is not limited herein. The high level of Vcc_aux provides a 5V constant voltage output through the linear voltage stabilizing source 50.

In this case, Vcc_aux is a high level, so that the zener diode ZD1 in the drive and logic conversion module 20 is turned on and broken down, the drive MOS transistor Q3 is turned on, the drive of the transistor Q4 in the discharge module 30 becomes low, and the transistor Q4 is turned off. Neither transistor Q4 nor resistor R9 of discharge module 30 operates, that is, discharge module 30 does not participate in operation.

Upon the external switch being turned off, the LED drive circuit stops working, the voltage on the main winding (i.e. pins 2 and 4) of the power inductor L2 is zero, and the voltage on the auxiliary winding (i.e. pins 6 and 8) of the power inductor L2 after magnetic coupling is also zero. Because the capacitance of the capacitor C1 is small, Vcc_aux quickly goes low (i.e., Vcc_aux voltage is zero). Because the output terminal of the linear voltage stabilizing source 50 has a large electrolytic capacitor EC2, it remains unchanged at 5V for a short period of time after the circuit is powered off.

In this case, Vcc_aux is a low level, so that the zener diode ZD1 is turned off, the MOS transistor Q3 is turned off, the driving of the transistor Q4 becomes high, and the transistor Q4 is turned on. Transistor Q4 and resistor R9 operate, that is, the discharge module 30 operates. The energy on the output electrolytic capacitor EC1 will be quickly released through the resistor R9 and the transistor Q4. In this case, the voltage on the output electrolytic capacitor EC1 is approximately zero.

The external switch is turned on again, Vcc_aux quickly goes high, MOS transistor Q3 is turned on, and transistor Q4 is turned off. The electrolytic capacitor EC1 will gradually rise with the operating voltage of the switch module 40 until the currently operating LED is fully lit.

So far, the whole circuit has completed the switching function of the color temperature of the LED illumination device, and the LED illumination device will not have visual stroboscopic phenomenon during the switching of the color temperature. Similarly, the above method is also applicable when the brightness of light source is switched by a switch, or when the brightness and color temperature of light sources are switched simultaneously by a switch.

The present disclosure provides a combinational circuit and a control circuit.

An aspect according to the present disclosure a combinational circuit, applied to an LED drive circuit, including: a detection module and a drive and logic conversion module connected with the detection module, the detection module is configured to detect a state of an external switch, generate a detection signal according to the state of the external switch as detected, and send the detection signal to the drive and logic conversion module;

the drive and logic conversion module is configured to receive the detection signal from the detection module, generate a driving signal according to the detection signal, and drive an operation state of a discharge module for discharging an output electrolytic capacitor of the LED drive circuit by using a state of the driving signal.

Optionally, if the state of the external switch is OFF, the detection signal generated by the detection module according to the state of the external switch is a low level, the driving signal generated by the drive and logic conversion module according to the detection signal of the low level is a high level, and the discharge module is driven to work to discharge the output electrolytic capacitor of the LED drive circuit;

if the state of the external switch is ON, the detection signal generated by the detection module according to the state of the external switch is a high level, the driving signal generated by the drive and logic conversion module according to the detection signal of the high level is a low level, and the discharge module does not work.

Optionally, the detection module includes a first resistor, a capacitor device, a diode, and an auxiliary winding of a power inductor, the first resistor is connected in parallel with the capacitor device, and the diode and the auxiliary winding of the power inductor are connected in series and then connected in parallel with the capacitor device;

if the state of the external switch is ON, a voltage on the auxiliary winding of the power inductor is a high-frequency pulsating alternating-current square wave, and the voltage on the auxiliary winding of the power inductor generates the detection signal of a high level after being rectified and filtered by the diode and the capacitor device; if the state of the external switch is OFF, the diode is turned off and the detection signal of a low level is generated.

Optionally, the drive and logic conversion module includes a zener diode and a MOS transistor, one end of the zener diode is connected with the capacitor device, and the other end of the zener diode is connected with a gate electrode of the MOS transistor;

if the detection signal generated by the detection module is a low level, the zener diode is turned off, the MOS transistor is turned off, the driving signal of a high level is generated and applied to the discharge module, and the output electrolytic capacitor is discharged through the discharge module;

if the detection signal generated by the detection module is a high level, the zener diode is turned on and broken down, the MOS transistor is turned on, and the driving signal of a low level is generated and applied to the discharge module, and the discharge module does not work.

Another aspect of the present disclosure provides a control circuit, applied to an LED drive circuit, including a switch module, a discharge module, and any one of the abovementioned combinational circuit, the switch module is connected with at least two sets of light sources, and is configured to receive a switching signal from an external switch and switch a color temperature and/or brightness of the at least two sets of light sources according to the switching signal;

the discharge module is respectively connected with the switch module and the drive and logic conversion module in the combinational circuit, and is configured to receive the driving signal output by the drive and logic conversion module, drive a self-state by using a state of the driving signal, and discharge the output electrolytic capacitor of the LED drive circuit upon the self-state being an operation state, so that the output electrolytic capacitor does not discharge through a light source which currently emits light after the switch module switches the color temperature and/or brightness of the at least two sets of light sources.

Optionally, the control circuit is used for controlling or eliminating flicker of light source upon the LED driving circuit switching the color temperature and/or brightness of the at least sets of two light sources by using a switch.

Optionally, a condition for the external switch to generate the switching signal includes: if the state of the external switch is ON, the switching signal is generated upon the external switch being turned off and then turned on.

Optionally, the discharge module includes a second resistor and a triode, one end of the second resistor is connected with a base of the triode, the other end of the second resistor is connected with one end of the output electrolytic capacitor, and the other end of the output electrolytic capacitor is connected with an emitter of the triode;

if the state of the external switch is OFF, the detection signal generated by the detection module of the combinational circuit according to the state of the external switch is a low level, the driving signal generated by the drive and logic conversion module according to the detection signal of a low level is a high level, the triode is driven to be conductive, and the output electrolytic capacitor is discharged through the second resistor and the triode.

Optionally, the at least two sets of light sources include light sources of at least two colors, and different sets of the at least two sets of light sources have different colors.

Optionally, different sets of the at least two sets of light sources have different numbers of light sources.

Optionally, the at least two sets of light sources include light sources of at least two colors, and different sets of the at least two sets of light sources have different colors and different numbers of light sources.

Optionally, the control circuit further includes:

a linear voltage stabilizing source, connected with the detection module of the combinational circuit, and configured to receive the detection signal of the detection module and provide a stable voltage to the drive and logic conversion module according to the detection signal.

The combinational circuit in the examples of the present disclosure is applied to an LED drive circuit, and the combinational circuit includes a detection module and a drive and logic conversion module connected with the detection module. the detection module is configured to detect a state of an external switch, generate a detection signal according to the state of the external switch as detected, and send the detection signal to the drive and logic conversion module; the drive and logic conversion module is configured to receive the detection signal from the detection module, generate a driving signal according to the detection signal, and drive an operation state of a discharge module for discharging an output electrolytic capacitor of the LED drive circuit by using a state of the driving signal. Therefore, in the examples of the disclosure, the detection module and the drive and logic conversion module are disposed in a LED drive circuit, so that the operation state of the discharge module is driven by the cooperation of the two modules, and the discharge module discharges the output electrolytic capacitor of the LED drive circuit, so that the LED light source does not flicker due to residual energy on the output electrolytic capacitor. For example, in a process of switching the color temperature and/or brightness of the light source by using a switch, the LED light source will not have visual stroboscopic effect, thus improving the user experience of users.

The present disclosure also provides an LED drive circuit. The LED drive circuit may include a detection circuit and a drive and logic conversion circuit connected with the detection circuit. The detection circuit may be configured to detect a state of an external switch, generate a detection signal according to the state of the external switch as detected, and send the detection signal to the drive and logic conversion circuit; and the drive and logic conversion circuit may be configured to receive the detection signal from the detection circuit, generate a driving signal according to the detection signal, and drive an operation state of a discharge circuit for discharging an output electrolytic capacitor of the LED drive circuit by using a state of the driving signal.

For the LED drive circuit, when the state of the external switch is OFF, the detection signal generated by the detection circuit according to the state of the external switch is a low level, the driving signal generated by the drive and logic conversion circuit according to the detection signal of the low level is a high level, and the discharge circuit is driven to work to discharge the output electrolytic capacitor of the LED drive circuit; and when the state of the external switch is ON, the detection signal generated by the detection circuit according to the state of the external switch is a high level, the driving signal generated by the drive and logic conversion circuit according to the detection signal of the high level is a low level, and the discharge circuit does not work.

The detection circuit of the LED drive circuit may include a first resistor, a capacitor device, a diode, and an auxiliary winding of a power inductor, where the first resistor may be connected in parallel with the capacitor device, and the diode and the auxiliary winding of the power inductor may be connected in series and are connected in parallel with the capacitor device; and when the state of the external switch is ON, a voltage on the auxiliary winding of the power inductor is a high-frequency pulsating alternating-current square wave, and the voltage on the auxiliary winding of the power inductor generates the detection signal of a high level after being rectified and filtered by the diode and the capacitor device; and when the state of the external switch is OFF, the diode is turned off and the detection signal of a low level is generated.

For the LED drive circuit, the drive and logic conversion circuit may include a zener diode and a MOS transistor, where one end of the zener diode may be connected with the capacitor device, and the other end of the zener diode may be connected with a gate electrode of the MOS transistor; and when the detection signal generated by the detection circuit is a low level, the zener diode is turned off, the MOS transistor is turned off, the driving signal of a high level is generated and applied to the discharge circuit, and the output electrolytic capacitor is discharged through the discharge circuit; and when the detection signal generated by the detection circuit is a high level, the zener diode is turned on and broken down, by which the MOS transistor is driven to turn on, and the driving signal of a low level is generated and applied to the discharge circuit, and the discharge circuit does not work.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

In the specification provided herein, numerous specific details are set forth. However, it will be understood that examples of the present disclosure may be practiced without these specific details. In some instances, well-known methods, structures, and techniques have not been shown in detail so as not to obscure the understanding of the present specification.

Similarly, it should be understood that, in the above description of examples of the present disclosure, various features of the present disclosure are sometimes grouped together into a single example, figure, or description thereof in order to streamline the present disclosure and help understand one or more of the various inventive aspects.

At the present point, those skilled in the art will recognize that although a plurality of examples of the present disclosure have been shown and described in detail herein, many other variations or modifications consistent with the principles of the present disclosure can be directly determined or derived from the present disclosure without departing from the spirit and scope of the present disclosure. Therefore, the scope of the present disclosure should be understood and recognized to cover all such other variations or modifications.

What is claimed is:

1. A combinational circuit, applied to an LED drive circuit, comprising: a detection module and a drive and logic conversion module connected with the detection module, and wherein:

the detection module is configured to detect a state of an external switch, generate a detection signal according to the state of the external switch as detected, and send the detection signal to the drive and logic conversion module; and the drive and logic conversion module is configured to receive the detection signal from the detection module, generate a driving signal according to the detection signal, and drive an operation state of a discharge module for discharging an output electrolytic capacitor of the LED drive circuit by using a state of the driving signal.

2. The combinational circuit according to claim 1, wherein:

when the state of the external switch is OFF, the detection signal generated by the detection module according to the state of the external switch is a low level, the driving signal generated by the drive and logic conversion module according to the detection signal of the low level is a high level, and the discharge module is driven to work to discharge the output electrolytic capacitor of the LED drive circuit; and when the state of the external switch is ON, the detection signal generated by the detection module according to the state of the external switch is a high level, the driving signal generated by the drive and logic conversion module according to the detection signal of the high level is a low level, and the discharge module does not work.

3. The combinational circuit according to claim 2, wherein:

the detection module comprises a first resistor, a capacitor device, a diode, and an auxiliary winding of a power inductor, wherein the first resistor is connected in parallel with the capacitor device, and the diode and the auxiliary winding of the power inductor are connected in series and are connected in parallel with the capacitor device; and when the state of the external switch is ON, a voltage on the auxiliary winding of the power inductor is a high-frequency pulsating alternating-current square wave, and the voltage on the auxiliary winding of the power inductor generates the detection signal of a high level after being rectified and filtered by the diode and the capacitor device; and when the state of the external switch is OFF, the diode is turned off and the detection signal of a low level is generated.

4. The combinational circuit according to claim 3, wherein:

the drive and logic conversion module comprises a zener diode and a MOS transistor, wherein one end of the zener diode is connected with the capacitor device, and the other end of the zener diode is connected with a gate electrode of the MOS transistor; and when the detection signal generated by the detection module is a low level, the zener diode is turned off, the MOS transistor is turned off, the driving signal of a high level is generated and applied to the discharge module, and the output electrolytic capacitor is discharged through the discharge module; and when the detection signal generated by the detection module is a high level, the zener diode is turned on and broken down, by which the MOS transistor is driven to turn on, and the driving signal of a low level is generated and applied to the discharge module, and the discharge module does not work.

5. A control circuit, applied to an LED drive circuit, comprising: a switch module, a discharge module, and the combinational circuit, and wherein the combinational circuit comprises: a detection module and a drive and logic conversion module connected with the detection module, and wherein:

the detection module is configured to detect a state of an external switch, generate a detection signal according to the state of the external switch as detected, and send the detection signal to the drive and logic conversion module; and the drive and logic conversion module is configured to receive the detection signal from the detection module, generate a driving signal according to the detection signal, and drive an operation state of a discharge module for discharging an output electrolytic capacitor of the LED drive circuit by using a state of the driving signal; and wherein the switch module is connected with at least two sets of light sources, and is configured to receive a switching signal from an external switch and switch a color temperature and/or brightness of the at least two sets of light sources according to the switching signal; and wherein the discharge module is respectively connected with the switch module and the drive and logic conversion module in the combinational circuit, and is configured to receive the driving signal output by the drive and logic conversion module, drive a self-state by using a state of the driving signal, and discharge the output electrolytic capacitor of the LED drive circuit upon the self-state being an operation state, so that the output electrolytic capacitor does not discharge through a light source which currently emits light, after the switch module switches the color temperature and/or brightness of the at least two sets of light sources.

6. The control circuit according to claim 5, wherein the control circuit is used for controlling or eliminating flicker of light source upon the LED driving circuit switching the color temperature and/or brightness of the at least sets of two light sources by using a switch.

7. The control circuit according to claim 5, wherein a condition for the external switch to generate the switching signal comprises: when a state of the external switch is ON, the switching signal is generated upon the external switch being turned off and then turned on.

8. The control circuit according to claim 5, wherein:

the discharge module comprises a second resistor and a triode, one end of the second resistor is connected with a collector of the triode, the other end of the second resistor is connected with one end of the output electrolytic capacitor, and the other end of the output electrolytic capacitor is connected with an emitter of the triode; and when a state of the external switch is OFF, the detection signal generated by the detection module of the combinational circuit according to the state of the external switch is a low level, the driving signal generated by the drive and logic conversion module according to the detection signal of a low level is a high level, the triode is driven to be conductive, and the output electrolytic capacitor is discharged through the second resistor and the triode.

9. The control circuit according to claim 5, wherein the at least two sets of light sources comprise light sources of at least two colors, and different sets of the at least two sets of light sources have different colors.

10. The control circuit according to claim 5, wherein different sets of the at least two sets of light sources have different numbers of light sources.

11. The control circuit according to claim 5, wherein the at least two sets of light sources comprise light sources of at least two colors, and different sets of the at least two sets of light sources have different colors and different numbers of light sources.

12. The control circuit according to claim 5, further comprising:

a linear voltage stabilizing source that is connected with the detection module of the combinational circuit, and is configured to receive the detection signal of the detection module and provide a stable voltage to the drive and logic conversion module according to the detection signal.

13. An LED drive circuit, comprising: a detection circuit and a drive and logic conversion circuit connected with the detection circuit, and wherein:

the detection circuit is configured to detect a state of an external switch, generate a detection signal according to the state of the external switch as detected, and send the detection signal to the drive and logic conversion circuit; and the drive and logic conversion circuit is configured to receive the detection signal from the detection circuit, generate a driving signal according to the detection signal, and drive an operation state of a discharge circuit for discharging an output electrolytic capacitor of the LED drive circuit by using a state of the driving signal.

14. The LED drive circuit according to claim 13, wherein:

when the state of the external switch is OFF, the detection signal generated by the detection circuit according to the state of the external switch is a low level, the driving signal generated by the drive and logic conversion circuit according to the detection signal of the low level is a high level, and the discharge circuit is driven to work to discharge the output electrolytic capacitor of the LED drive circuit; and when the state of the external switch is ON, the detection signal generated by the detection circuit according to the state of the external switch is a high level, the driving signal generated by the drive and logic conversion circuit according to the detection signal of the high level is a low level, and the discharge circuit does not work.

15. The LED drive circuit according to claim 14, wherein:

the detection circuit comprises a first resistor, a capacitor device, a diode, and an auxiliary winding of a power inductor, wherein the first resistor is connected in parallel with the capacitor device, and the diode and the auxiliary winding of the power inductor are connected in series and are connected in parallel with the capacitor device; and when the state of the external switch is ON, a voltage on the auxiliary winding of the power inductor is a high-frequency pulsating alternating-current square wave, and the voltage on the auxiliary winding of the power inductor generates the detection signal of a high level after being rectified and filtered by the diode and the capacitor device; and when the state of the external switch is OFF, the diode is turned off and the detection signal of a low level is generated.

16. The LED drive circuit according to claim 15, wherein:

the drive and logic conversion circuit comprises a zener diode and a MOS transistor, wherein one end of the zener diode is connected with the capacitor device, and the other end of the zener diode is connected with a gate electrode of the MOS transistor; and when the detection signal generated by the detection circuit is a low level, the zener diode is turned off, the MOS transistor is turned off, the driving signal of a high level is generated and applied to the discharge circuit, and the output electrolytic capacitor is discharged through the discharge circuit; and when the detection signal generated by the detection circuit is a high level, the zener diode is turned on and broken down, by which the MOS transistor is driven to turn on, and the driving signal of a low level is generated and applied to the discharge circuit, and the discharge circuit does not work.

* * * * *